US008869314B2

(12) United States Patent
Peper et al.

(10) Patent No.: US 8,869,314 B2
(45) Date of Patent: Oct. 28, 2014

(54) BRA STRAP COVERING DEVICE

(75) Inventors: Beverly Diana Peper, Glen Mills, PA (US); Vicki Lynn Conteh, Glen Mills, PA (US)

(73) Assignee: Perteh, Wilmington, DE (US)

( * ) Notice: Subject to any disclaimer, the term of this patent is extended or adjusted under 35 U.S.C. 154(b) by 25 days.

(21) Appl. No.: 13/530,801

(22) Filed: Jun. 22, 2012

(65) Prior Publication Data

US 2012/0324631 A1 Dec. 27, 2012

Related U.S. Application Data

(60) Provisional application No. 61/500,177, filed on Jun. 23, 2011.

(51) Int. Cl.

| | |
|---|---|
| ***A41F 15/00*** | (2006.01) |
| ***A41D 27/08*** | (2006.01) |
| ***A41F 15/02*** | (2006.01) |
| *A41F 19/00* | (2006.01) |
| *A63B 55/00* | (2006.01) |

(52) U.S. Cl.

CPC ..... *A41D 27/08* (2013.01); *A41F 15/02* (2013.01); *A41F 15/007* (2013.01); *A41F 15/00* (2013.01); *A63B 55/008* (2013.01)

USPC ..... 2/336; 2/338; 2/310; 2/312; 2/244; 2/246; 450/86; 450/88

(58) Field of Classification Search

CPC ..... A41F 15/007; A41F 15/02; A41F 15/00; A41F 15/005; A41D 27/08; A63B 55/008; Y10S 224/907; Y10S 2/92; A45C 13/30

See application file for complete search history.

(56) References Cited

U.S. PATENT DOCUMENTS

| | | | | | |
|---|---|---|---|---|---|
| 2,006,640 | A | * | 7/1935 | Hubbell | 351/159.41 |
| 2,497,808 | A | * | 2/1950 | Zacks | 2/268 |
| 2,643,380 | A | * | 6/1953 | Blair | 2/460 |
| 2,676,737 | A | * | 4/1954 | Zirbel | 224/264 |
| 2,689,348 | A | * | 9/1954 | Crawford | 2/460 |
| 2,849,723 | A | * | 9/1958 | Marino | 2/323 |
| 3,848,270 | A | * | 11/1974 | Rand | 2/311 |
| 4,575,874 | A | * | 3/1986 | Johnson | 2/460 |
| 4,581,271 | A | * | 4/1986 | Gordon | 428/67 |
| 4,612,935 | A | * | 9/1986 | Greifer | 450/86 |
| 4,741,574 | A | * | 5/1988 | Weightman et al. | 297/482 |
| 4,764,988 | A | * | 8/1988 | Reaver | 2/268 |
| 4,766,682 | A | * | 8/1988 | Malloy, III | 36/132 |
| D298,386 | S | * | 11/1988 | Hirahara | D3/327 |
| 4,795,400 | A | * | 1/1989 | Greenberg | 450/86 |
| 4,879,768 | A | * | 11/1989 | McClees et al. | 224/264 |
| 4,918,758 | A | * | 4/1990 | Rendina | 2/171 |
| 4,945,576 | A | * | 8/1990 | Melton | 2/460 |
| 5,003,640 | A | * | 4/1991 | Pizzacar | 2/209.13 |
| 5,172,428 | A | * | 12/1992 | Leinoff | 2/181 |
| 5,201,078 | A | * | 4/1993 | Melton | 2/268 |
| D340,798 | S | * | 11/1993 | Starkey | D2/609 |
| D341,712 | S | * | 11/1993 | Fulcher | D2/639 |

(Continued)

*Primary Examiner* — Bobby Muromoto, Jr.
(74) *Attorney, Agent, or Firm* — Cozen O'Connor

(57) ABSTRACT

A covering device for attachment around a bra-strap having three panels, wherein the panels are substantially the same length as the strap length and at least as wide as the strap width, and wherein the two side panels having complementary pairs of fastening devices to secure the side panels around the bra-strap, thereby securing the bra-strap between the panels.

18 Claims, 7 Drawing Sheets

(56) References Cited

U.S. PATENT DOCUMENTS

| | | | | | |
|---|---|---|---|---|---|
| 5,287,559 | A | * | 2/1994 | Christiansen et al. | 2/181 |
| 5,309,608 | A | * | 5/1994 | Lucas | 24/304 |
| D354,842 | S | * | 1/1995 | Imre | D2/891 |
| 5,388,743 | A | * | 2/1995 | Silagy | 224/264 |
| 5,428,844 | A | * | 7/1995 | Dougherty | 2/209.13 |
| D365,912 | S | * | 1/1996 | Fulcher et al. | D2/639 |
| 5,517,695 | A | * | 5/1996 | Murray | 2/195.1 |
| 5,539,931 | A | * | 7/1996 | Fizer et al. | 2/268 |
| 5,558,556 | A | * | 9/1996 | Froehlich | 450/86 |
| 5,566,871 | A | * | 10/1996 | Weintraub | 224/264 |
| 5,595,332 | A | * | 1/1997 | Freedman | 224/264 |
| 5,600,855 | A | * | 2/1997 | Ramirez | 2/209.13 |
| 5,626,507 | A | * | 5/1997 | Gillen | 450/86 |
| 5,691,028 | A | * | 11/1997 | Curtis | 428/101 |
| D396,938 | S | * | 8/1998 | Bugatti | D2/639 |
| 5,795,030 | A | * | 8/1998 | Becker | 297/488 |
| 5,852,829 | A | * | 12/1998 | Relaford | 2/338 |
| 5,857,220 | A | * | 1/1999 | Erny et al. | 2/244 |
| 5,913,413 | A | * | 6/1999 | Huyck | 2/459 |
| 5,914,166 | A | * | 6/1999 | Le | 428/40.1 |
| 6,006,362 | A | * | 12/1999 | Walsh | 2/209.13 |
| 6,086,451 | A | * | 7/2000 | Fernandes | 450/86 |
| 6,135,852 | A | * | 10/2000 | Young | 450/86 |
| 6,279,168 | B1 | * | 8/2001 | Bean | 2/209.13 |
| 6,282,725 | B1 | * | 9/2001 | Vanidestine, Jr. | 2/421 |
| 6,283,821 | B1 | * | 9/2001 | Wang | 450/88 |
| 6,318,609 | B1 | * | 11/2001 | Swierz | 224/264 |
| 6,339,848 | B1 | * | 1/2002 | Mayhood et al. | 2/338 |
| 6,443,921 | B1 | * | 9/2002 | Kaplan | 602/64 |
| 6,656,013 | B1 | * | 12/2003 | Wang | 450/86 |
| 6,715,186 | B1 | * | 4/2004 | Huang | 24/299 |
| 6,752,466 | B2 | * | 6/2004 | Liang | 297/482 |
| 6,807,680 | B2 | * | 10/2004 | Sloot | 2/16 |
| 6,859,945 | B1 | * | 3/2005 | Crawford | 2/336 |
| 6,922,876 | B2 | * | 8/2005 | Kobayashi | 24/633 |
| D518,412 | S | * | 4/2006 | Berke et al. | D11/200 |
| D519,261 | S | * | 4/2006 | Reis | D2/706 |
| 7,086,926 | B2 | * | 8/2006 | Falla | 450/93 |
| 7,222,372 | B1 | * | 5/2007 | Bruckart et al. | 2/106 |
| D545,528 | S | * | 7/2007 | Washington | D2/706 |
| D577,476 | S | * | 9/2008 | Hyde | D2/706 |
| D578,732 | S | * | 10/2008 | Samuels et al. | D2/706 |
| D578,733 | S | * | 10/2008 | Samuels et al. | D2/706 |
| 7,833,085 | B2 | * | 11/2010 | Crouch | 450/86 |
| D648,920 | S | * | 11/2011 | Dorsey | D2/639 |
| 8,061,068 | B1 | * | 11/2011 | Donovan | 40/586 |
| 8,272,076 | B2 | * | 9/2012 | Tobey | 2/452 |
| D672,138 | S | * | 12/2012 | Hale | D3/215 |
| 8,366,511 | B2 | * | 2/2013 | Morello | 450/86 |
| D677,894 | S | * | 3/2013 | Santivasci | D3/318 |
| D684,623 | S | * | 6/2013 | Tobey | D16/339 |
| 8,469,772 | B2 | * | 6/2013 | Crouch | 450/86 |
| 2001/0042261 | A1 | * | 11/2001 | Bean | 2/209.13 |
| 2002/0043834 | A1 | * | 4/2002 | Jackson et al. | 297/228.1 |
| 2003/0003844 | A1 | * | 1/2003 | Jones et al. | 450/88 |
| 2003/0186619 | A1 | * | 10/2003 | Falla et al. | 450/86 |
| 2004/0206432 | A1 | * | 10/2004 | Cirone | 150/154 |
| 2006/0037358 | A1 | * | 2/2006 | Zuffoletto | 63/1.11 |
| 2006/0156586 | A1 | * | 7/2006 | Brunelle-Wright | 36/89 |
| 2007/0006614 | A1 | * | 1/2007 | Martz | 63/15 |
| 2007/0119810 | A1 | * | 5/2007 | Boles | 215/365 |
| 2009/0117826 | A1 | * | 5/2009 | Crouch | 450/86 |
| 2010/0071118 | A1 | * | 3/2010 | Tobey | 2/452 |
| 2010/0186258 | A1 | * | 7/2010 | Garza | 36/101 |
| 2011/0016616 | A1 | * | 1/2011 | Crouch | 2/338 |
| 2011/0155076 | A1 | * | 6/2011 | Charette | 119/795 |
| 2011/0230120 | A1 | * | 9/2011 | Tully et al. | 450/88 |
| 2011/0269376 | A1 | * | 11/2011 | Clim | 450/86 |
| 2012/0233842 | A1 | * | 9/2012 | Tobey | 29/428 |

* cited by examiner

BRA STRAP COVERING DEVICE

FIELD OF INVENTION

The present invention relates to bra devices and more particularly pertains to a new bra-strap covering device to cover the straps of a bra and to securely fasten the bra cover, without the need to purchase a special bra or the need for adhesives to prevent the bra-strap covering from sliding.

BACKGROUND OF THE INVENTION

There are various types of women's clothing, which, may, at times allow the straps of a bra, worn underneath the article of clothing, to be visible. These include various types of "sleeveless garments" including but not limited to shirts, tank-tops, tube-tops, lingerie, halter tops, dresses, blouses, coats, and the like.

Many people find the appearance of bra straps to be unsightly, and tacky and there is a need to identify a product that can help to hide bra straps, without having to purchase a specialty bra, designed to eliminate straps. Bras are often costly and some women find that only certain types of bra's fit their body shape and provide the necessary support. It may, therefore, not be practical for some women to purchase additional bra's for certain clothes, so that the straps are not seen.

U.S. Pat. No. 7,833,085 identifies a bra cover that requires the use of double sided adhesive to secure the bra cover to the strap of the bra. The use of such adhesive is problematic as it may damage the strap material, and leave sticky residue from the adhesive. Furthermore, as the adhesive wears off, the bra cover will not be useable.

Accordingly, there is a need for a cover for a bra-strap or straps of a sleeveless garment that can be selectively secured to said straps without the use of adhesives. The present invention provides an effective device to cover the strap of a bra, to prevent the unsightly view of bra-straps when worn with clothing that would allow the bra-straps to be seen.

SUMMARY OF THE INVENTION

A covering device for attachment around a bra-strap wherein the covering device has three panels, wherein the panels are substantially the same length as the strap length and at least as wide as the strap width, where the two side panels having complementary pairs of fastening devices to secure the side panels around the bra-strap, thereby securing the bra-strap between the panels.

A further embodiment of the invention is a covering device for attachment to a sleeveless garment strap and optionally a bra-strap wherein the covering device has three panels, wherein the panels are substantially the same length as the strap length and at least as wide as the strap width, where the two side panels having complementary pairs of fastening devices to secure the side panels around the bra-strap, thereby securing the bra-strap between the panels.

A further embodiment of the invention is a covering device for attaching around the straps of a bra or sleeveless garment, wherein the covering device comprises five panels, a center panel, two elastic panels attached to the center panel, and two side panels attached to the elastic panels, where the two side panels having complementary pairs of fastening devices to secure the side panels around the bra-strap, thereby securing the bra-strap between the panels, and where said center and side panels are made of a fabric material comprising at least two layers of fabric.

DETAILED DESCRIPTION OF THE PREFERRED EMBODIMENTS

The embodiments of the invention and the various features and advantages thereto are more fully explained with references to the non-limiting embodiments and examples that are described and illustrated in the accompanying drawings and set forth in the following descriptions of those drawings. The figures in the accompanying drawings are not drawn to scale and the features of one embodiment may be employed with the other embodiments as the skilled artisan recognizes, even if not explicitly stated herein. Descriptions of well-known components and techniques may be omitted to avoid obscuring the invention. The examples used herein are intended merely to facilitate an understanding of ways in which the invention may be practiced and to further enable those skilled in the art to practice the invention. Accordingly, the examples and embodiments set forth herein should not be construed as limiting the scope of the invention, which is defined by the appended claims.

As used herein, the term "about" means within 10% of a stated number.

As used herein the term "sleeveless garment" means any article of clothing where the amount of material from the neck to the end of the sleeve is less than about 6 inches. "Sleeveless garments" may include but not limited to shirts, tank-tops, tube-tops, lingerie, halter tops, dresses, blouses, coats, and the like. Typically, a sleeveless garment includes tank-tops or tops with "spaghetti" type straps, where the shoulders are visible. These garments often allow for the straps of a bra to be seen when a bra is worn underneath the sleeveless garment.

As used herein the term "complementary pair of securing means" means a paired mechanism for securing two pieces of fabric together, such as a hook and eye, button and hole, zipper, hook and look material, male and female snaps, eye and string, snap tape, magnets, and other such mechanisms that require a pair of features to secure two pieces of fabric together.

FIG. 1A shows a woman wearing a sleeveless garment 19. FIG. 1A represents one example of a type of garment that includes thin supporting straps 18, which are similar in nature to bra-straps.

Figure 1:
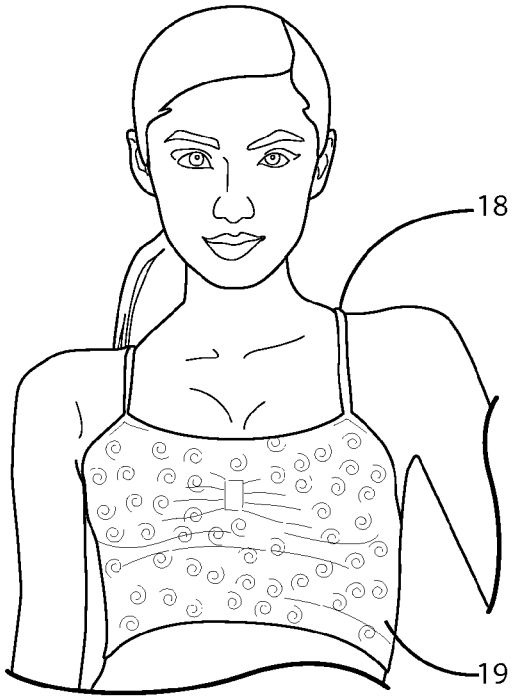
FIG. 1 is a perspective view of a woman wearing a Sleeveless garment 19 with thin supporting straps 18 and no bra-strap cover.
Figure 2:
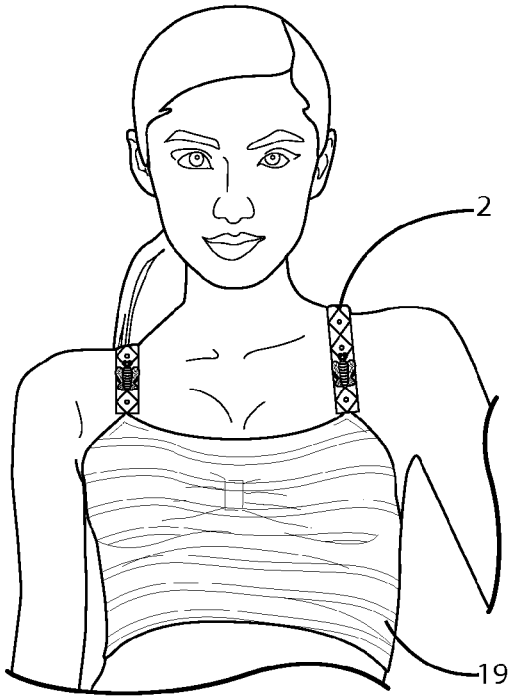
FIG. 2 is a perspective view of a woman wearing a Sleeveless garment 19 with an embodiment of the bra-strap cover.

FIG. 2 depicts an embodiment of the invention described herein, identifying a bra-strap cover 2, shown in a fastened position, which wraps around a supporting strap 18 (as shown in FIG. 1) and encloses it, so that the supporting strap 18 cannot be seen.

FIG. 2 further depicts the invention described herein being utilized to cover a sleeveless garment strap. Additionally, the bra-strap cover 2 may also cover the straps of a sleeveless garment and a bra strap within a bra-strap cover 2, so as to enclose and cover both the bra-strap and the sleeveless garment straps within the same bra-strap cover 2. This allows a wearer to wear both a bra and a sleeveless garment with small straps and cover them with one bra-strap cover 2.

Figure 3A:
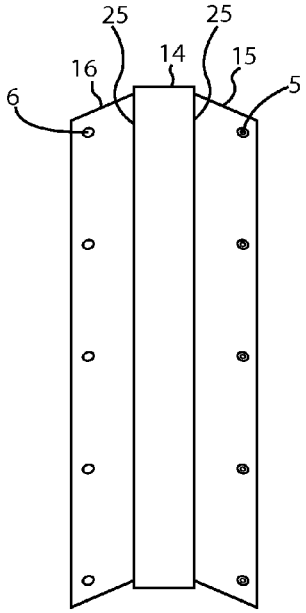
FIGS. 3A, 3B, and 3C are perspective views of embodiments of the bra-strap cover described herein.

FIG. 3A shows an embodiment of a bra-strap cover 2 identifying panels 14, 15, and 16 and snaps 5 and 6, attached thereto. Panels 15 and 16 are intended to wrap around a strap, to secure the bra-strap cover 2 to the strap. Panels 14, 15, and 16, are a tri-fold design, wherein the side panels 15 and 16 are intended to fold or wrap over each other and thereby secure an item between the side panels and the center panel 14. Panels 14, 15, and 16, have a length and a width, where the length is about the same length as a seamless garment strap 18 or a bra strap. The width of panel 14 is wider than the width of a seamless garment strap 18. Panels 15 and 16, are about the same width as panel 14. In other embodiments, panels 15 and 16 are about 25% to about 90%, or about 33% to about 75%, or about 50% of the width of panel 14.

Panels 14, 15, and 16, may be be made of a variety of materials, including fabrics of materials like cotton, polyester, silk, wool, mohair, velvet, satin, angora, linen, twill, denim, cashmere, taffeta, leather, crepe, calico, rayon, lace, elastic cotton, spandex, elastic or stretchable blends of the foregoing fabrics, and other natural and synthetic fibers. The panels 14, 15, and 16 may be made of a single piece of fabric, so that there are no seams 25 between panels, or may be made of multiple pieces of fabric, so that panels 14, 15, and 16 are attached and contain a seam 25. The panels are attached to one another, typically with thread, and sewn together creating the seam 25. The seam 25 also represents a latitudinal edge of the panels. Each panel may be a single layer of fabric, or multiple layers of fabrics, as necessary. Different fabrics may be used for each layer, where multiple layers are used, and panels 14, 15, and 16, need not be made of the same material or fabric. In certain instances, the materials to make panels 14, 15, and 16 may also include plastics or metal.

Figure 3B:
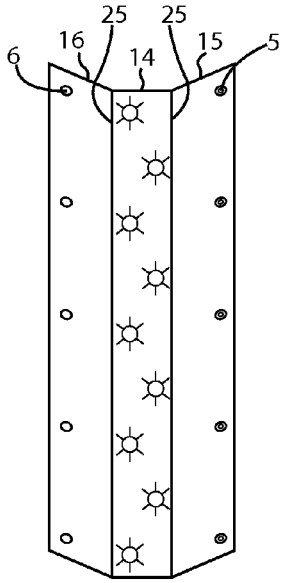
Figure 3C:
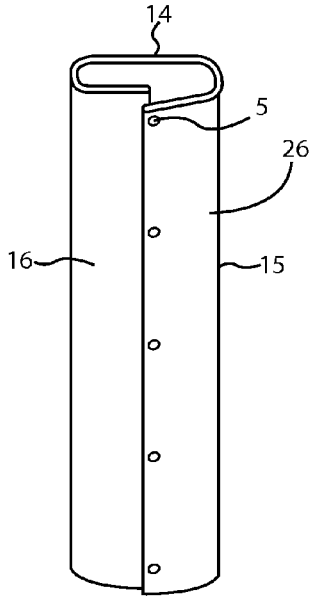

The snaps 5, and 6 utilized in FIGS. 3A, 3B, and 3C, may be made of a plastic or metal material and may be any variety of known snap type mechanism to fasten panel 15 to panel 16, so that it is secure, but also removable. The snaps may include mechanical or magnetic attachments, or both. Panels 14, 15, and 16 may be made of an elastic material so as to allow the panels to stretch around bra-straps or multiple straps to be secured in the bra-strap cover 2.

Panel 14, as identified in FIG. 3A is longer than panels 15 and 16. The extra length on panel 14 allows this panel to extend past the other panels so as to extend over a length of clothing in some embodiments. The panel 14 may be from about 1 mm to about 20 mm longer than panels 15 and 16, or from about 1 mm to about 10 mm, or about 10 mm longer than panels 15 and 16.

FIG. 3B shows an embodiment of a bra-strap cover 2 from the top view. This view shows the design on the top face of panel 14. The design on panel 14 may be made of a variety of materials and may be simply a piece of fabric, of any color or pattern, or it may include a fabric as well as ornamentation added to the top face of panel 14, including, but not limited to stones, metals, plastics, or other fabric, that are attached to panel 14. The ornamentation may protrude above the panel 14, and it may also be of a larger width than panel 14, such that when the bra-strap cover 2 is lying flat, the ornamentation extend past the edges of panel 14. The ornamentation may be attached to the top face of panel 14 via a fastening device such as hook and loop material, glue, adhesive, stitching, or other manner. However, the ornamentation may also be the fabric itself.

FIG. 3C identifies an embodiment of the invention utilizing a single piece of fabric 26, where panels 14, 15, and 16, are not specifically differentiated. FIG. 3C, for example, identifies an embodiment without seams between each panel, and identifies that panels 15 and 16, fold over one another. A benefit of this embodiment is that the bra strap cover 2 can be secured around straps that are wider than typical straps, as the width of panel 14 is not predetermined. There may be a single layer of fabric, or multiple layers of fabric used to create the panels in this embodiment.

Figure 4A:
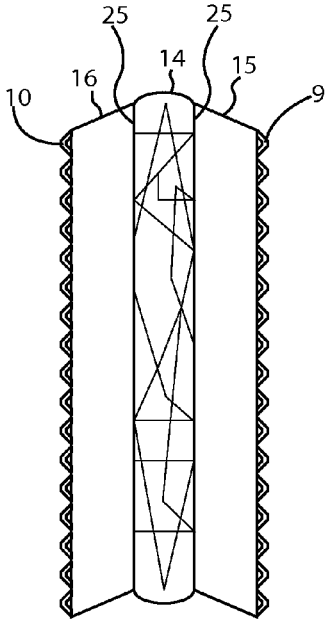
FIGS. 4A, 4B, and 4C are perspective views of embodiments of the bra-strap cover described herein.
Figure 4B:
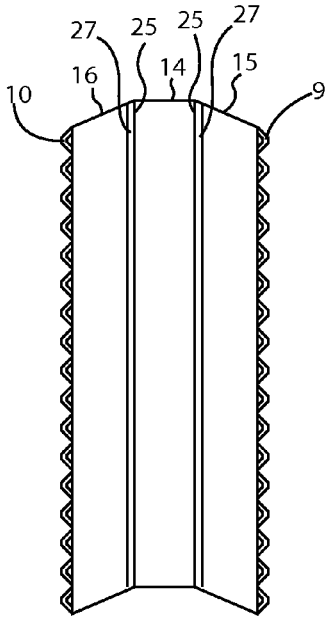
Figure 4C:
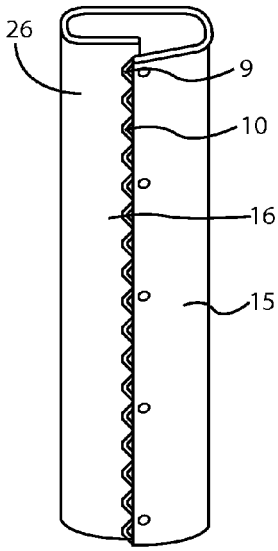

FIGS. 4A through 4C show similar elements as FIGS. 3A-3C. Here panels 15 and 16 are attached via a zipper mechanism.

FIG. 4A, in particular, like FIG. 3A identifies panel 14 as extending past panels 15 and 16, where at the longitudinal end of panel 14, the edges are rounded. The longitudinal end is the end notated by the lines marked by numbers 14, 15, and 16 in FIG. 4A.

FIG. 4B discloses the use of a stretchable material secured between panels 14 and 15, and 14 and 16. Elastic materials are frequently used to allow for stretching of materials. By using a small elastic panel 27, about 0.1 to about 1 inch in width, between panels 14 and 15, and 14 and 16, the elastic panel 27 can stretch to accommodate bulky straps or straps that are wider than usual, for example. By using the elastic panel 27, two additional seams 25 are created as compared to FIG. 4A, which does not use the elastic panel 27.

Figure 5A:
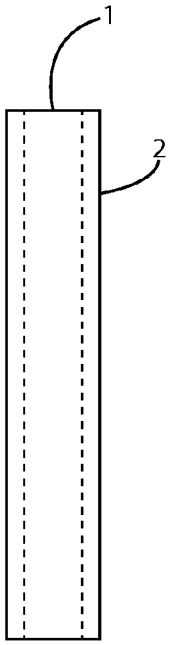
FIG. 5A is a perspective view of one embodiment of the bra-strap cover 2.

FIG. 5A shows the bra-strap cover 2 and shows a bra-strap 1, as dotted lines. This identifies that a bra-strap 1, is intended to be enclosed and covered by the bra-strap cover 2, and that the bra-strap cover 2 is intended to be wider than the bra-strap 1.

Figure 5B:
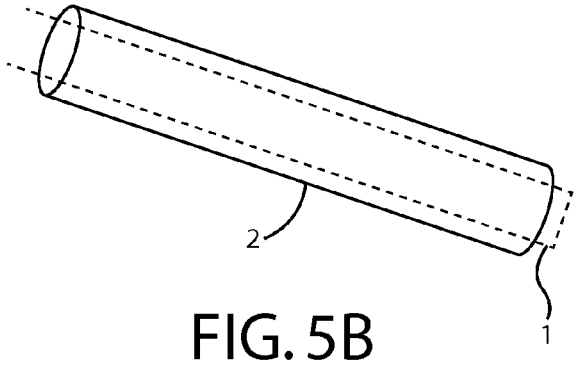
FIG. 5B is a perspective view of one embodiment of the bra-strap cover 2 as it surrounds the bra-strap (dotted lines) 1.

FIG. 5B shows that the bra-strap cover 2 is intended to surround the bra-strap 1, so as to provide an enclosure of the bra-strap 1. In view of FIG. 5B, panels 15 and 16 wrap around the bra-strap 1, so that the bra strap 1 is in contact with the bottom face of panel 14 on one side of the bra-strap 1 and is in contact with the bottom face of panels 15 and/or 16 on the other side of the bra-strap 1. This effectively secures the bra-strap between the panels, securing the bra-strap cover 2, around the bra-strap 1.

Figure 6A:
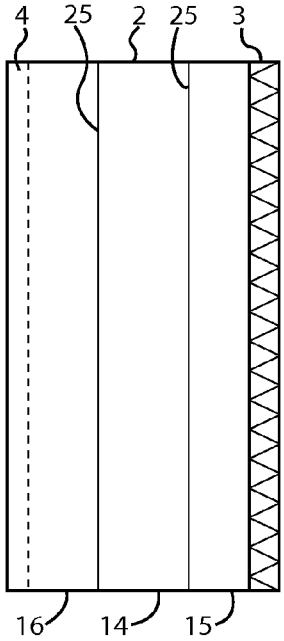
FIGS. 6A and 6B are perspective views of the front and back side of one embodiment of the bra-strap cover identifying panels 14, 15, and 16.
Figure 6B:
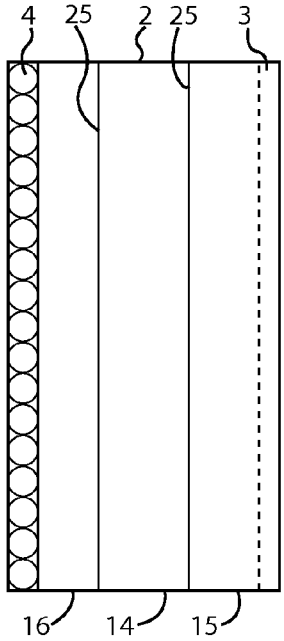

FIGS. 6A and 6B show an embodiment of the top and bottom view of a bra-strap cover 2, utilizing a hook and loop material to attach panel 15 to panel 16. FIG. 6A identifies that the hook material or loop material on panel 16 is on the obverse side, where as the opposing complementary hook or loop material is on the side shown in FIG. 6A on panel 15. FIG. 6B shows the reverse of FIG. 6A. The hook and loop material provides a secure means to attach the panels together, but allowing the bra-strap cover 2, to be removed when necessary. Accordingly, the complementary pair of materials are situated on half on the top side of one panel and the other complementary material on the bottom side of the opposing panel.

Figure 7A:
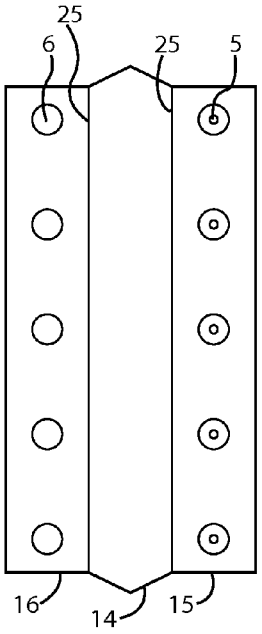
FIGS. 7A, 7B, and 7C are perspective views of embodiments of the bra-strap cover.
Figure 7B:
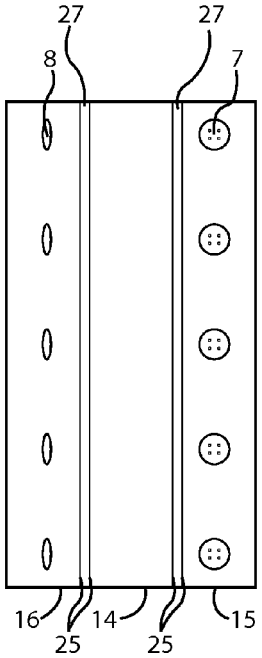
Figure 7C:
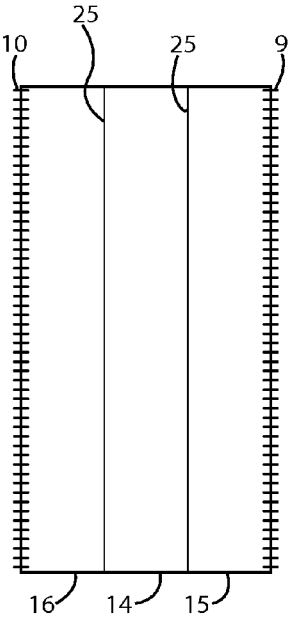

FIGS. 7A, 7B, and 7C identify three embodiments of the invention. FIG. 7A uses male snaps 5 and female snaps 6 to secure panels 15 and 16 together, FIG. 7B utilizes buttons 7 and holes 8, to secure panels 15 and 16 together, and FIG. 7C utilizes a zip mechanism, with 9 and 10 each being one half of a paired zipper to secure panels 15 and 16 together. Each of the pairs 3 and 4, 5 and 6, 7 and 8, and 9 and 10 are each complementary pairs, to fasten panels 15 and 16. These are merely a short list of examples of how panels 15 and 16 may be attached so that they can be attached securely, but also still being removable from a bra-strap 2 or from the supporting straps 18 of a sleeveless garment 19. Other fastening devices may include magnetic fastener, clasps, button and loops, string and hole, hook and eye, snaps, and snap tape, as a non-exhaustive list.

FIG. 7A, like FIGS. 3A and 4A is depicted where panel 14 is longer than panels 15 and 16. Panel 14, as identified in FIG. 7A terminates at the longitudinal end with a triangular point. Furthermore, FIG. 7A identifies an embodiment where male snaps are placed on the bottom face of panel 15 and the female side of the snaps are on the top face on panel 16, together forming a complementary pair to secure panels 15 and 16, where panel 16 is situated below panel 15, allowing the male and female snaps to be secured.

FIGS. 7A, 3A, and 4A, each identify various embodiments where panel 14 is longer than panels 15 and 16. The added length of panel 14 in each of these embodiments allows for different placement of features such as hooks 11, multiple hooks 13, or clasp 17 (shown in FIGS. 8A, 8C, and 8D) on the bottom face of panel 14. Each of these features may be placed at the end of panel 14, so that hooks 11, would be situated on panel 14 past the longitudinal edge of panels 15 and 16. The features in other embodiments can also be placed even with the longitudinal edge of panels 15 and 16, or can be placed behind the longitudinal edge of panels 15 and 16. The extra length of panel 14 allows the movement of these features based on the needs to secure the bottom face of panel 14. Further, the position of hooks 11, multiple hooks 13, and clasps 17 are moveable on panel 14. The hooks 11 and multiple hooks 13.

FIG. 7B, like FIG. 4B identifies an elastic panel 27, between panels 14 and 16, and 14 and 15. The use of this material creates additional seams 25, but allows for added movement and flexibility of panels 14 and 16 as they wrap around a strap.

Figure 8A:
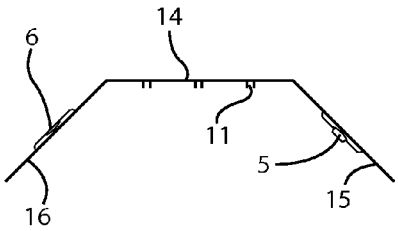
FIGS. 8A, 8B, 8C, and 8D, are perspective views of embodiments of the bra-strap cover.

FIG. 8A shows an embodiment of the bra-strap cover 2, but with panels 15 and 16, folded partly below panel 14, and from the perspective of looking down the longitudinal length of panels 14, 15, and 16, so that one can see additional features of the invention. Hooks 11, are positioned on the bottom face of panel 14, so that they will be in contact with either the bra, bra-strap 1, sleeveless garment 19, or thin supporting straps 18, to secure the bra-strap cover 2 in place. The hooks 11 are devised so as to secure the bra-strap cover 2 to a particular garment and allow the bra-strap cover 2 to stay securely attached to the garment or strap, so that the bra-strap cover 2 does not slide up or down on the bra-straps 1.

The hooks 11 are oriented approximately perpendicular to the seam 25 and thus are about parallel with the longitudinal edge of panel 14. The hooks 11 are intended to be about 0.1 to about 20 mm from the longitudinal edge of panel 14, and are to be centered on panel 14 between the seams 25. In instances where panel 14 is longer than panels 15 and 16, the hooks 11, may be situated forward of the longitudinal edge of panels 15 and 16.

In this manner, the hooks 11, may be placed at one or both ends of the bottom face of panel 14, which secures the underside of panel 14 to a sleeveless garment. The hooks 11 are made of metal, plastic, or other suitable material such that they are secured within the material of either a bra, or a sleeveless garment, and serve as a sort of "hooks" as in a hook and loop fastening system, where the garment is the loop portion of the system. The hooks 11 are to be long enough to secure the bra-strap cover 2, but no longer than 5 mm in total length. It is expected that the hooks 11 will be about 1 or 2 mm in total length at an optimal length, but for some clothes, such as wool or heavy knit fabrics, longer lengths, such as 3-5 mm may be appropriate to secure the bra-strap 1 without risk of scratching the wearer. The hooks 11 should have a diameter of no more than 1 mm, so that it may pierce clothing, but not damage the fabric. The Hooks may be straight or be curved, such that a portion of the hook 11 is about parallel with the bottom face of panel 14. It is intended that there will be at least one hook 11, but that two or three hooks 11, or one to three pairs of hooks 11 (as identified in FIG. 8A) may be optimal for security and wear and tear on clothing.

Figure 8B:
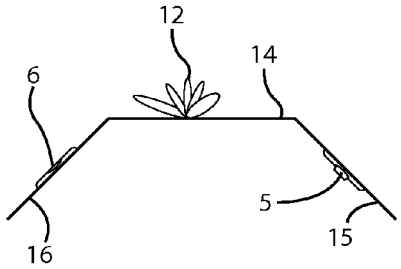

FIG. 8B identifies an embodiment of the bra-strap cover 2 without hooks 11, and identifies an ornamental feature 12, is attached to the top face of panel 14.

Figure 8C:
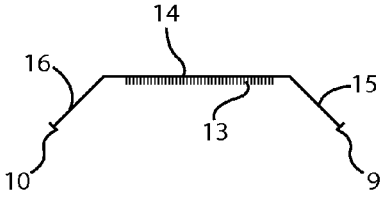

FIG. 8C identifies an embodiment utilizing multiple hooks 13 positioned on the bottom face of panel 14, with the purpose of the multiple hooks 13 to secure the bottom face of panel 14 to the bra, sleeveless garment 19, the bra-strap, or thin supporting strap, or a combinations thereof. As with the hooks 11, the multiple hooks 13 are of a length from approximately 1 to 5 mm, but may include numerous hooks configured in a single row of hooks, or in multiple rows of hooks, and are situated about perpendicular to the seam 25.

Figure 8D:
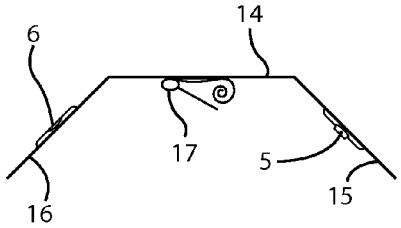

FIG. 8D identifies an embodiment of the invention utilizing a clasp 17 type attachment mechanism. For example, a safety pin may be a clasp 17, or any of commonly used jewelry clasps may be used. Other type of clasps, such as a "S" hook, or other similar hook may be utilized as a clasp 17. The clasp 17 may attach to any feature on the bra or sleeveless garment 19 to allow a secure attachment of the bottom face of panel 14.

Figure 9A:
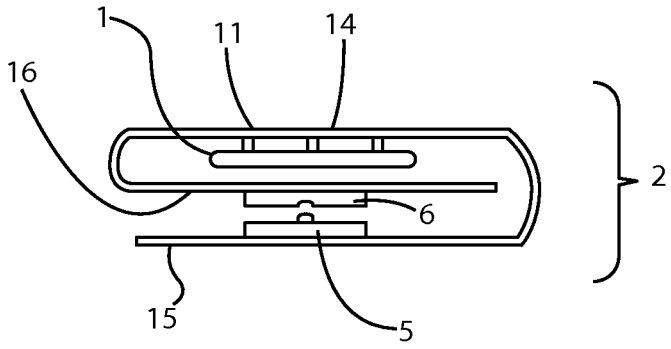
FIGS. 9A and 9B are perspective views of two embodiments of the bra-strap cover.

FIG. 9A identifies an embodiment of the bra-strap cover 2 in a folded position with the bra-strap 1 positioned between panels 14 and 16 and with panel 15 being secured to panel 16 via a complementary pair of snaps. FIG. 9A identifies the use of three pairs of hooks 11 situated on the bottom face of panel 14. FIG. 9A is drawn where panels 14, 15 and 16 are made of two layers of material. The use of two layers, is advantageous as features such as the hooks 11 may be attached to the bottom face of panel 14, and elements of the hooks 11, necessary for attachment, may be attached through one layer of material, but not a second layer. Similarly, a decoration on the top face of panel 14, may have stitching or other materials, that will be located between the two layers of material.

Figure 9B:
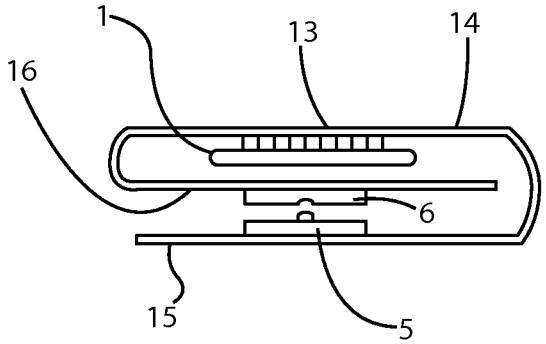

FIG. 9B identifies an embodiment of the bra-strap cover 2 in a folded position with the bra-strap 1 positioned between panels 14 and 16 and with panel 15 being secured to panel 16 via a complementary pair of snaps. FIG. 9B also shows that panels 14, 15, and 16 may be made of two, or more, layers of fabric. Furthermore, multiple hooks 13 are secured to the bottom face of panel 14 and are also in contact with the bra-strap 1, securing the bra-strap 1 to the bra-strap cover 2.

Figure 10:
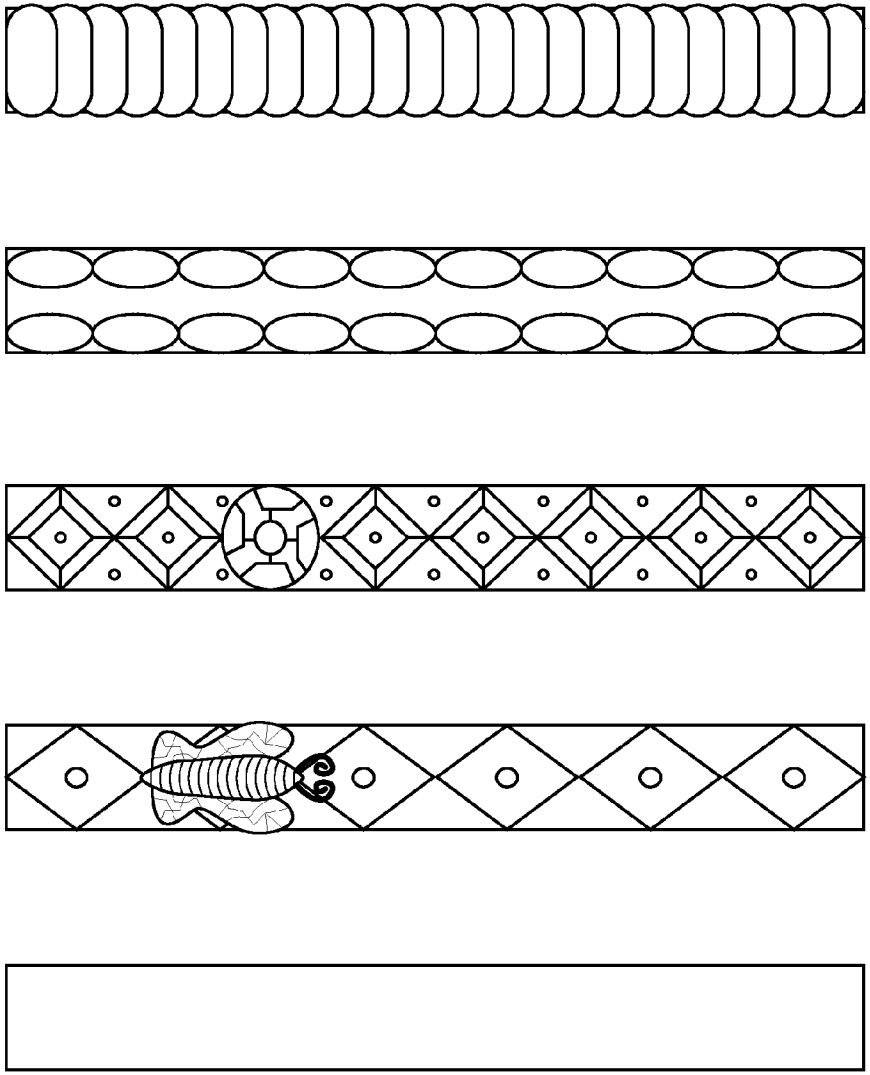
FIG. 10 is a perspective view of five examples of the top face of panel 14 according to the invention described herein.

FIG. 10 shows five different decorations for a bra-strap cover 2. The decorative portion would be either the fabric or material of panel 14 itself, or a decorative addition, affixed to the top face of panel 14. The fabric material of panel 14 may consist of two or more layers of fabric, where one is the bottom layer and a top layer fabric that is seen on the top face of panel 14. The decorative additions on the top face of panel 14 may also be affixed by adhesive, double-sided tape, glue, sewn into the material, or secured through other commonly known means to adhere a decoration to fabric.

The invention now being fully described, it will be apparent to one of ordinary skill in the art that many changes and modification can be made thereto without departing from the spirit or scope of the appended claims.

What is claimed is:

1. A covering device for attachment around a bra-strap, with the strap having a top side, a bottom side, a strap length, and a strap width; and a. the covering device having a center panel and two side panels attached to the center panel, the center panel having a top face and a bottom face, a panel length, a panel width, and longitudinal ends; and each side panel having a side panel length, a side panel width, and a complementary pair of securing means, wherein the panel lengths are substantially equal to the strap length, wherein the panel width is at least as wide as the strap width;

b. wherein the covering device further comprises at least one hooking device on the bottom face positioned substantially parallel to a longitudinal end and centered within the bottom face no more than about 10 mm from a longitudinal end, the hooking device comprising at least one metal or plastic prong having a prong length and diameter, the prong length being less than about 5 mm in length, and having a diameter of less than about 1 mm, wherein the hooking device prevents the covering device from sliding or moving when attached to the strap; and c. wherein the two side panels wrap around the strap and are secured together with the complementary pair of securing means and surround the strap and the hooking device so that the strap is secured between the bottom face and the side panels with the strap top side being in contact with the bottom face, and substantially covers the strap.

2. The covering device of claim 1, wherein the complementary pair of securing means is selected from the group consisting of hook and loop material, snap fasteners, buttons, magnets, clasps, button and loop, hook and eye, string and hole, and combinations thereof.

3. The covering device of claim 1 wherein the prong is less than about 3 mm in length and having a diameter of less than about 0.5 mm and having a curvature so that about one third of the prong length is about parallel with the panel cover.

4. The covering device of claim 1, wherein the covering device panels and panels are made of fabric or woven material selected from the group consisting of cotton, polyester, silk, wool, mohair, velvet, satin, angora, linen, twill, denim, cashmere, taffeta, leather, crepe, calico, rayon, lace, elastic cotton, spandex, elastic, natural and synthetic fibers, and combinations thereof.

5. The covering device of claim 1, wherein ornamental features are attached to the top face of the covering device and attached by a mechanism selected from the group consisting of hook-and loop material, snap fastener, buttons, double-sided adhesive, stitching, zipper, hook and eye, magnet, and combinations thereof.

6. The covering device of claim 5, wherein the ornamental features are selected from the group consisting of fabric, stones, metals, plastic, and combinations thereof.

7. The covering device of claim 1, wherein the center panel and two cover panels are made of a single piece of fabric.

8. The covering device of claim 1, wherein the center panel and two cover panels are made of at least two layers of fabric.

9. A covering device for attachment to a sleeveless garment strap and optionally a bra-strap, each strap having a top side, a bottom side, a strap length, and a strap width; and a. the covering device having a center panel and two side panels attached to the center panel, the center panel having a top face and a bottom face, a panel length, a panel width, and longitudinal ends; and each side panel having a side panel length, a side panel width, and a complementary pair of securing means, wherein the panel length and side panel lengths are substantially equal to the strap length, wherein the panel width is at least as wide as the strap width, or the bra-strap width, whichever is wider;

b. further comprising at least one hooking device on the bottom face positioned substantially parallel to the longitudinal end and centered within the bottom face no more than about 10 mm from the longitudinal end, the hooking device comprising at least one metal or plastic prong having a prong length and diameter, the prong length being less than about 5 mm in length, and having a diameter of less than about 1 mm, wherein said at least one hooking device secures the covering device to the strap so as to prevent the covering device from sliding or moving on the strap; and c. wherein the securing means are configured to secure the two side panels to each other when wrapped around the strap, and secure the covering device around the strap so that the strap and the hooking device are secured between the bottom face and the secured side panels so that the strap top side is in contact with the bottom face and substantially covers the at least one strap.

10. The covering device of claim 9, wherein the complementary pair of securing means is selected from the group consisting of hook and loop material, snap fasteners, buttons, magnets, clasps, button and loop, hook and eye, string and hole, and combinations thereof.

11. The covering device of claim 9 wherein the prong is less than about 3 mm in length and having a diameter of less than about 0.5 mm and having a curvature so that the prong extends about one mm below the panel cover.

12. The covering device of claim 9, wherein the covering device panels are made of fabric or woven material selected from the group consisting of cotton, polyester, silk, wool, mohair, velvet, satin, angora, linen, twill, denim, cashmere, taffeta, leather, crepe, calico, rayon, lace, elastic cotton, spandex, elastic, natural and synthetic fibers, and combinations thereof.

13. The covering device of claim 9, wherein an ornamental feature is attached to the top face of the covering device and is attached by a mechanism selected from the group consisting of hook-and loop material, snap fastener, buttons, double-sided adhesive, stitching, zipper, and combinations thereof.

14. The covering device of claim 13, wherein the ornamental feature is selected from the group consisting of fabric, stones, metals, plastic, and combinations thereof.

15. The covering device of claim 9 made of a single piece of fabric.

16. A covering device for attaching around the straps of a bra or sleeveless garment, wherein said strap has a strap length, a strap width, and a strap top side and a strap bottom side and comprising:

a. the covering device having a center cover panel, two elastic panels, and two side panels, said elastic panels being attached along the latitudinal edge of the center cover panel and to one latitudinal edge of a side panel;

b. said panels having a length substantially equal to the strap length, and said center cover panel having a width at least as wide as the strap width;

c. said side panels each containing one half of a complementary pair of securing means to secure the covering device to a strap;

d. said center cover panel and side panels being made of a synthetic or naturally occurring fabric and comprising at least two layers of fabric;

e. further comprising a hooking device secured on the underside of the center cover panel; wherein said hooking device secures to the strap to prevent the covering device from sliding on said strap; and f. wherein said side panels secure around said strap and thereby secure the hooking device and the strap between the panels of said covering device.

17. Said covering device of claim 16 further comprising ornamentation attached to the top face of the center cover panel by a mechanism selected from the group consisting of hook-and loop material, snap fastener, buttons, double-sided adhesive, stitching, zipper, snap tape, magnets, and combinations thereof.

18. The covering device of claim 16 further comprising at least two hooking devices, wherein at least one hooking device is situated near the longitudinal edge of each end of the covering device.

* * * * *